US009303935B2

(12) United States Patent
Milde, Jr.

(10) Patent No.: US 9,303,935 B2
(45) Date of Patent: Apr. 5, 2016

(54) SECURE SMARTPHONE-OPERATED GUN LOCK WITH MEANS FOR OVERRIDING RELEASE OF THE LOCK

(71) Applicant: Karl F. Milde, Jr., Mahopac, NY (US)

(72) Inventor: Karl F. Milde, Jr., Mahopac, NY (US)

( * ) Notice: Subject to any disclaimer, the term of this patent is extended or adjusted under 35 U.S.C. 154(b) by 0 days.

(21) Appl. No.: 14/562,854

(22) Filed: Dec. 8, 2014

(65) Prior Publication Data

US 2015/0184964 A1 Jul. 2, 2015

Related U.S. Application Data

(63) Continuation-in-part of application No. 14/140,658, filed on Dec. 26, 2013, now Pat. No. 8,931,195.

(51) Int. Cl.
*F41A 17/06* (2006.01)

(52) U.S. Cl.
CPC ..... *F41A 17/063* (2013.01); *F41A 17/066* (2013.01)

(58) Field of Classification Search
CPC ..... F41A 17/02; F41A 17/46; F41A 17/063; F41A 17/066; F41A 17/08; F41A 17/30; F41A 17/00
USPC ..... 42/70.11, 70.01, 70.07, 70.06, 66, 84
See application file for complete search history.

(56) References Cited

U.S. PATENT DOCUMENTS 3,939,679 A * 2/1976 Barker ..... E05B 47/068 341/181
5,461,812 A * 10/1995 Bennett ..... F41A 17/063 42/70.06
5,546,690 A * 8/1996 Ciluffo ..... F41A 17/066 340/5.52
5,675,925 A * 10/1997 Wurger ..... F41A 17/06 42/70.06
6,293,039 B1 * 9/2001 Fuchs ..... F41A 17/066 42/70.04
6,421,943 B1 * 7/2002 Caulfield ..... F41A 17/066 42/70.01
6,711,844 B2 * 3/2004 Rumfelt ..... F41A 17/063 42/70.11
8,049,597 B1 * 11/2011 Murakami ..... G06F 21/32 340/5.1
8,756,850 B2 * 6/2014 Dietel ..... F41A 11/02 42/70.11
2001/0042332 A1 * 11/2001 Gering ..... F41A 17/063 42/70.08
2002/0032976 A1 * 3/2002 Riener ..... F41A 17/063 42/70.11

(Continued)

OTHER PUBLICATIONS

Rodriguez, John, Yardarm Demonstrates the World's First Wireless Firearm Safety Technology for Connected Gun Owners, May 21, 2013; http://www.yardarmtech.com/in-the-news/test-in-the-news-1/.*

*Primary Examiner* — Joshua Freeman
(74) *Attorney, Agent, or Firm* — Karl F. Milde, Jr.

(57) ABSTRACT

A gun locking and unlocking device, which may be configured to be disposed on or in a gun to alternatively prevent or enable firing, includes a data receiver, a data memory and a logic device for determining whether security data received by the receiver is the same, or substantially the same, as data stored in the data memory. One or more separate electronic gun key devices are provided to transmit security data and gun control signals to the data receiver of the gun lock device. The logic device responds to the gun control signals transmitted by one of the gun key devices to lock or unlock the gun, respectively, when the received security data and the security data stored in memory are substantially similar. The logic device also automatically locks the gun when the gun is located more than a prescribed distance from the gun key device. In case of emergency the gun security feature can be bypassed (overridden) by transmitting a gun control command to either lock or unlock the gun.

7 Claims, 3 Drawing Sheets

(56) References Cited

U.S. PATENT DOCUMENTS

2002/0112390 A1* 8/2002 Harling ..... F41A 17/066 42/70.11
2004/0099134 A1* 5/2004 Gotfried ..... F41A 17/066 89/1.11
2006/0242879 A1* 11/2006 Schmitter ..... F41A 17/063 42/70.01
2007/0074438 A1* 4/2007 Parhofer ..... F41A 17/063 42/70.01
2008/0039962 A1 2/2008 McRae
2009/0064557 A1 3/2009 Hughes et al.
2009/0223104 A1* 9/2009 Anzeloni ..... F41A 17/063 42/70.06
2011/0030262 A1* 2/2011 O'Shaughnessy .... F41A 17/063 42/70.01
2011/0126622 A1* 6/2011 Turner ..... F41A 19/01 73/514.01
2012/0329446 A1 12/2012 Dietel
2013/0167423 A1* 7/2013 Lupher ..... F41A 17/06 42/70.06
2013/0180147 A1* 7/2013 Lupher ..... F41A 19/58 42/69.01
2014/0083318 A1* 3/2014 Templ ..... F41A 17/063 102/215
2014/0173961 A1* 6/2014 Goren ..... F41A 17/063 42/70.11
2014/0173962 A1 6/2014 Goren et al.
2014/0182179 A1* 7/2014 McHale ..... F41A 17/48 42/70.06
2014/0230296 A1* 8/2014 Kuparinen ..... F41A 17/063 42/1.01
2014/0259841 A1* 9/2014 Carlson ..... F41A 17/063 42/1.01
2014/0290109 A1* 10/2014 Stewart ..... F41A 17/08 42/70.01
2015/0184962 A1* 7/2015 Burdine ..... F41A 17/063 42/70.11

* cited by examiner

SECURE SMARTPHONE-OPERATED GUN LOCK WITH MEANS FOR OVERRIDING RELEASE OF THE LOCK

CROSS-REFERENCE TO RELATED APPLICATION

This application claims priority from the following co-pending U.S. patent applications:

(1) Provisional Application No. 61/761,270, filed Feb. 6, 2013, entitled "SECURE SMARTPHONE-OPERATED GUN TRIGGER LOCK;"

(2) patent application Ser. No. 13/763,951, filed Feb. 11, 2013, entitled "SECURE SMARTPHONE-OPERATED GUN TRIGGER LOCK" (now U.S. Pat. No. 8,893,420).

(3) Provisional Application No. 61/841,559, filed Jul. 1, 2013, entitled "SECURE SMARTPHONE-OPERATED GUN LOCK;"

(4) patent application Ser. No. 14/017,666 filed Sep. 4, 2013, entitled "SECURE SMARTPHONE-OPERATED GUN TRIGGER LOCK" (now U.S. Pat. No. 8,919,024); and (5) patent application Ser. No. 14/140,658, filed Dec. 26, 2013, entitled "SECURE SMARTPHONE-OPERATED GUN LOCK WITH MEANS FOR OVERRIDING RELEASE OF THE LOCK"(now U.S. Pat. No. 8,931,195).

This application is a continuation-in-part of the aforesaid patent application Ser. No. 14/140,658.

To the fullest extent permitted by law, the contents of these applications are incorporated herein by reference.

BACKGROUND OF THE INVENTION

The present invention relates to a system for locking and unlocking a gun, such as a pistol or rifle, to prevent a person from firing an unlocked gun when he or she has not been authorized by the gun owner to do so.

The aforementioned U.S. patent application Ser. No. 13/763,951, filed Feb. 11, 2013 (now U.S. Pat. No. 8,893,420) discloses a gun lock system which uses a "smartphone," such as an Apple "iPhone," with a suitable application ("phone app") as an "electronic key" to unlock a gun. The smartphone transmits biologic identification ("BioID") data about a person to an electronic lock on or in the gun which, in turn, matches it with pre-stored data and unlocks the gun if a proper match is found. This system allows only the gun owner (or some other person who is licensed or otherwise authorized), who has originally supplied their BioID data to the gun lock for storage, to use the gun. The system is difficult to compromise and yet allows the gun to be unlocked by any smartphone that can collect BioID data and transmit it to the gun. This system avoids the problem of unlocking a gun when the user's smartphone has been lost, stolen or broken or has been replaced by a new one, because any smartphone with a suitable app may be used as the electronic key.

With this system, as with any system for locking a gun for security purposes, the gun may be operated and fired by an unauthorized person once it has been unlocked by an authorized person. As an example, an unauthorized person might grab an unlocked gun away from the gun owner and use it against him or her in a hostile situation such as a burglary. It would be desirable in such situations to prevent a previously unlocked gun from firing.

SUMMARY OF THE INVENTION

An object of this invention, therefore, is to provide a secure smartphone-operated gun lock with means for overriding the prior authorized release of the lock when the gun is being held by an unauthorized person.

This object, as well as other objects which will become apparent from the discussion that follows, are achieved, in accordance with the present invention, by providing means for locking the gun and maintaining the gun in the locked state whenever it is located more than a prescribed distance away from the smartphone which served as an electronic key to unlock the gun. In this way, if an unauthorized person grabs and attempts to use the gun, the gun will not fire if it is more than a few feet away from the authorized user who holds the key.

In particular, the present invention provides an improvement in apparatus for locking and unlocking a gun to control its use, which apparatus comprises:

(a) a gun lock device configured to be disposed on a gun and responsive to at least one electric signal to select between two operative states, a locked state which prevents the gun from firing and an unlocked state which enables firing;

(b) a data receiver for receiving (1) a gun control signal that specifies one of a locked and an unlocked state, and (2) gun security data;

(c) a data memory for storing gun security data; and (d) a first logic device, coupled to the data receiver and to the data memory, for comparing gun security data received by the data receiver with gun security data stored in the data memory, and for producing the at least one electric signal to actuate the gun lock device in dependence upon the gun control signal and upon whether the stored gun security data and the received gun security data are substantially similar.

According to an important aspect of the invention, therefore, the first logic device is operative to cause the gun lock device to either enable the gun to be fired or to prevent the gun from being fired, depending upon whether the stored gun security data and the received gun security data are substantially similar. In this way, any person having a gun key capable of sending (1) a gun control signal that specifies one of a locked and an unlocked state, and (2) the gun security data, can control the operation of the gun.

The gun security data can comprise a pseudo-random number and/or it preferably includes data, such as biologic data, identifying a putative authorized person who wishes to control the operation of the gun.

The term "substantially similar" is intended to mean that the data are sufficiently similar to indicate a match. Biologic identification ("BioID") data obtained at different times about the same person are never exactly the same, however. Nevertheless, it is sufficiently similar to make it possible to determine with fair certainty whether such data, obtained at different times, identifies the same person.

According to the invention the apparatus for locking and unlocking a gun further comprises a gun key device having a data transmitter for transmitting a gun control signal and gun security data to the data receiver. The gun key device preferably includes:

(1) a first input device, for inputting information from a putative authorized person who wishes to control the gun; and (2) a second logic device, coupled to each of the data transmitter and the first input device, for generating gun security data defined by the putative authorized person for transmission to the data receiver.

The putative authorized person is recognized as a person authorized to control the gun in the event the transmitted gun security data is substantially similar to gun security data stored in the data memory.

According to the invention, means are provided for determining the distance between the gun key device and the gun lock device and for setting and maintaining the gun in the locked state when this distance exceeds a prescribed distance in the range, for example, of five to ten feet. In this way, if a gun, which has been unlocked by its owner or other authorized person, is grabbed away by a hostile person, the gun will lock and remain locked until it is unlocked again by the owner or other authorized person.

In a preferred embodiment of the invention the gun lock device further comprises a first GPS locater coupled to the first logic device and the gun key device further comprises a second GPS locater coupled to the second logic device. The second logic device is operative to produce a signal representing the location of the gun key device, as determined by the second GPS locater, for transmission to the data receiver and the first logic device is operative to set the gun lock device in a locked state and prevent the gun from firing when the first logic device determines that the gun key device is greater than the prescribed distance from the gun lock device.

As normally provided, the smartphone has a microphone which is used for voice communication. This microphone can also be used to either lock or unlock the gun in an emergency situation when the owner feels threatened. By speaking a "secret word" or phrase known only to the owner of the gun, the owner can override and bypass the gun security features provided by the gun lock app. This is realized by detecting the word or phrase, either by an algorithm in the smartphone 10 or in the gun lock device itself, e.g., by transmission via Bluetooth, and once detected, either locking or unlocking the gun, respectively, in dependence upon the secret word.

For a full understanding of the present invention, reference should now be made to the following detailed description of the preferred embodiments of the invention as illustrated in the accompanying drawings.

DETAILED DESCRIPTION OF THE PREFERRED EMBODIMENT

Figure 1:
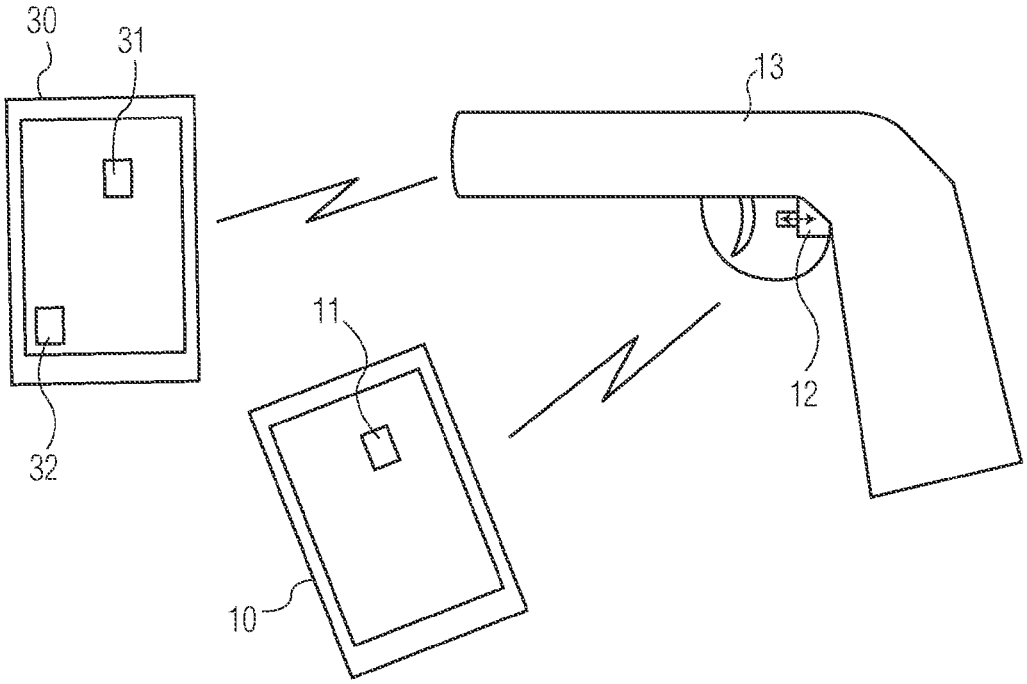
FIG. 1 is a representational diagram showing a gun that is equipped with a gun lock according to the present invention and two smartphones that serve as electronic keys to lock and unlock the gun.

The preferred embodiment of the present invention will now be described with reference to FIGS. 1-4 of the drawings. Identical elements in the various figures are identified with the same reference numerals.

Briefly in overview, a battery-operated gun-locking device is permanently attached to, or installed on and incorporated into a gun. For example a trigger lock may be installed in a recess behind the trigger or in the lower receiver mechanism of the gun. In its default condition, a movable member is in a forward position, blocking rearward movement of the trigger. When unlocked, the movable member is drawn rearward to allow movement of the trigger.

The gun-locking device has a Bluetooth or other type of wireless receiver and a memory with stored security data. When data matching this stored data is received from a smartphone or similar device, the gun-locking device enables the gun to be locked or unlocked by the user of the smartphone.

FIG. 1 illustrates this configuration. A smartphone 10 has an app that presents a screen button 11 called "Gun Lock" for each gun the smartphone owner owns or is licensed to use. By pressing this button on the app, the owner sends a password, a pseudo-random number or biologic ID security data by a Bluetooth wireless connection to a locking and unlocking device 12 installed permanently in a gun 13.

As normally provided, the smartphone has a microphone which is used for voice communication. This microphone can also be used to either lock or unlock the gun in an emergency situation when the owner feels threatened. By speaking a "secret word" or phrase known only to the owner of the gun, the owner can override and bypass the gun security features provided by the gun lock app. This is realized by detecting the word or phrase, either by an algorithm in the smartphone 10 or in the gun lock device itself, e.g., by transmission via Bluetooth, and once detected, either locking or unlocking the gun, respectively, in dependence upon the secret word.

One or more additional smartphones 30 may be provided with an app that presents a screen button 31 called "Gun Lock" that may be used to lock and/or unlock a particular gun (using the password, a pseudo-random number or biologic ID security data) or, as a master key, to lock all guns in the vicinity of the Bluetooth connection. Like the smartphone 10, this smartphone 30 may have a GPS locater 32 that causes the app to automatically send out a signal to lock the gun(s) whenever the smartphone 30 senses that the gun 13, or any other gun, is within its Bluetooth connection area. In this way, the gun 13 (and/or any other gun) may be locked against firing when in the vicinity of a school or any other area where the firing of guns is prohibited.

Alternatively or in addition, the GPS locater may be disposed on the gun lock device itself to automatically lock the gun: (1) when the smartphone or the gun are within a prescribed geographical area, (2) when the GPS locater in the smartphone is greater than a prescribed distance from the GPS locater in the gun lock device, and/or (3) when the smartphone and/or the gun are within a prescribed distance from a certain person who is protected by a court order against possible violence by the gun owner or user. In the latter case, the protected person carries the smartphone 30 with the GPS locater. The logic device within the gun lock compares the GPS location of the gun with the GPS location of the smartphone 30, transmitted to the gun for example by Bluetooth, and causes the gun lock 12 to operate to prevent the gun from firing when the two locations are within a prescribed distance from each other.

In the case of option (2) noted above, the gun will be locked, or if already locked it will remain locked, if and when the gun is a prescribed distance, preferably in the range of five to ten feet, from the smartphone(s) 10 and/or 30, carried by the owner or other authorized person. In this way, a person who grabs the gun away from its owner or other authorized user, cannot fire the gun.

Figure 2:
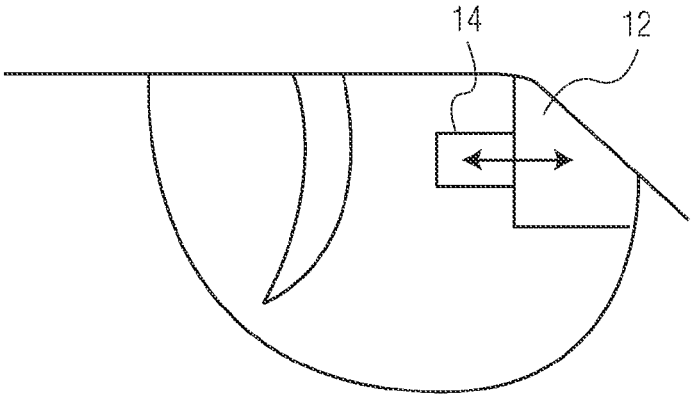
FIG. 2 is a close-up view of the trigger region of the gun of FIG. 1 with the gun lock installed.

FIG. 2 shows a trigger-locking device 12 with a movable member 14, which may be used as a gun locking device. When the device receives a data packet that matches the corresponding data stored in its memory, it draws the movable member 14 back, allowing the trigger to fire the weapon.

The smartphone can be made secure in any number of ways. It can be password protected or, preferably, it can use of its camera to verify the ID of the person holding this device. For example, the security App may use face recognition or iris recognition software to identify the owner from the camera image.

When the gun locking device 12 is first used, the smartphone app can generate a pseudo-random number, representing either a chosen password or biologic information identifying the gun owner or other authorized user, and send it to the gun locking device for storage in its permanent memory. Once stored, this number can be changed only by the authorized person or a "registration person" that is duly licensed to perform this function, e.g. by a local or national government. Thereafter, whenever any smartphone sends this number again, the gun locking device responds to a command of this smartphone and either releases the lock or locks the lock, respectively, so that gun firing may be enabled or prevented in response to the command. Before sending each command, the user of the smartphone may be required to identify himself/herself by entering the password or biologic identifying information into the phone for a recognition algorithm. This password or biologic ID information is sent to the gun locking device for matching with corresponding identifying data stored therein. Alternatively, the password or biologic ID information may be sent only once for a given period or gun use session and, if a match is found with the information stored in the gun lock device, this device remains responsive to gun control commands for the entire period or gun use session.

Firing the gun is therefore a two-step process for the gun owner or authorized user:

(1) Enter his/her identity into the smartphone; and (2) Press the Gun Unlock button to transmit this information to the gun lock device.

The gun lock device will then compare the received information with the information stored in memory and, if a match is found, will respond to commands received from the smartphone; e.g., either to lock or unlock the gun.

Once unlocked, the gun preferably remains unlocked until the gun user presses another button on the smartphone app, appropriately called "Gun Lock," or until the gun lock times out and automatically locks itself by restoring the gun lock to the locked position.

The gun locking device 12 is preferably powered by a replaceable and/or rechargeable battery (not shown).

Figure 3:
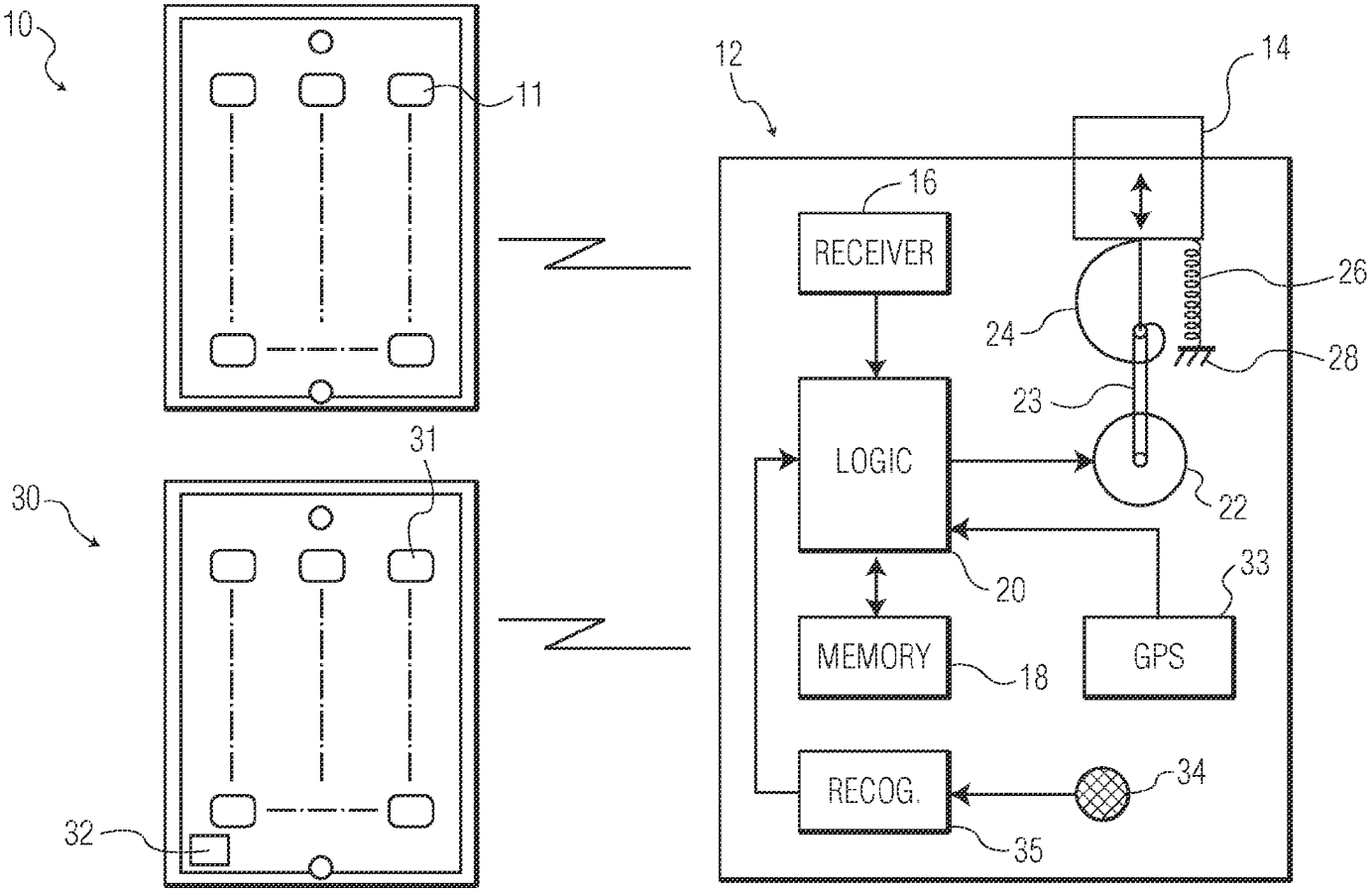
FIG. 3 is a block diagram showing a preferred embodiment of the gun lock according to the present invention.

FIG. 3 shows the individual elements of the gun lock apparatus. The smartphone(s) 10 and/or 30 transmit(s) to a receiver 16 in the gun locking device 12, preferably via a wireless Bluetooth connection. Alternatively, the smartphone may be coupled to the receiver by a wire connection, for example through a USB port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone(s) 10 and/or 30, the data may not be an exact match; however, the received signature data may be sufficiently close to the stored signature data to satisfy the requirement that the person holding the smartphone is indeed the owner of the gun or authorized to use it. Once the right to use the gun has been established, the user of the smartphone(s) 10 and/or 30 can unlock (or, alternatively, lock) the gun.

According to another embodiment of the invention, the gun locking device itself may include a GPS locater 33 and software that runs in the logic device 20, which automatically causes the gun to lock when it is brought into a proscribed geographical area, such as within a school or other public building or without an airport or shopping mall.

According to still another embodiment of the invention, the GPS location of the smartphone(s) 10 and/or 30 and the GPS location of the gun lock device 12 are provided to a common location (to either the smartphone(s) 10 and/or 30 or the gun lock device 12) where they are compared. If the distance between these two locations exceeds a prescribed maximum, indicating that the controlling smartphone is a given distance away from the gun, say five to ten feet, the gun lock device automatically locks the gun.

According to still another embodiment of the invention, the gun lock device 12 comprises a microphone 34 and a device 35 for recognizing a "secret word" or command from the use of the gun which causes the logic device to either lock or unlock the gun, respectively, when spoken and recognized. This feature allows the user to lock the gun in the case of an emergency if and when the gun is grabbed away from the owner or authorized person by an unauthorized person. It also allows the user to bypass the identification procedure when the gun must be used in the case of an emergency such as a burglary in the gun owner's home.

According to still another embodiment of the invention, the features of the smartphone 10 may be configured to be attachable to, or may be permanently incorporated into, the gun 13, for example on or in the handle grip.

Figure 4:
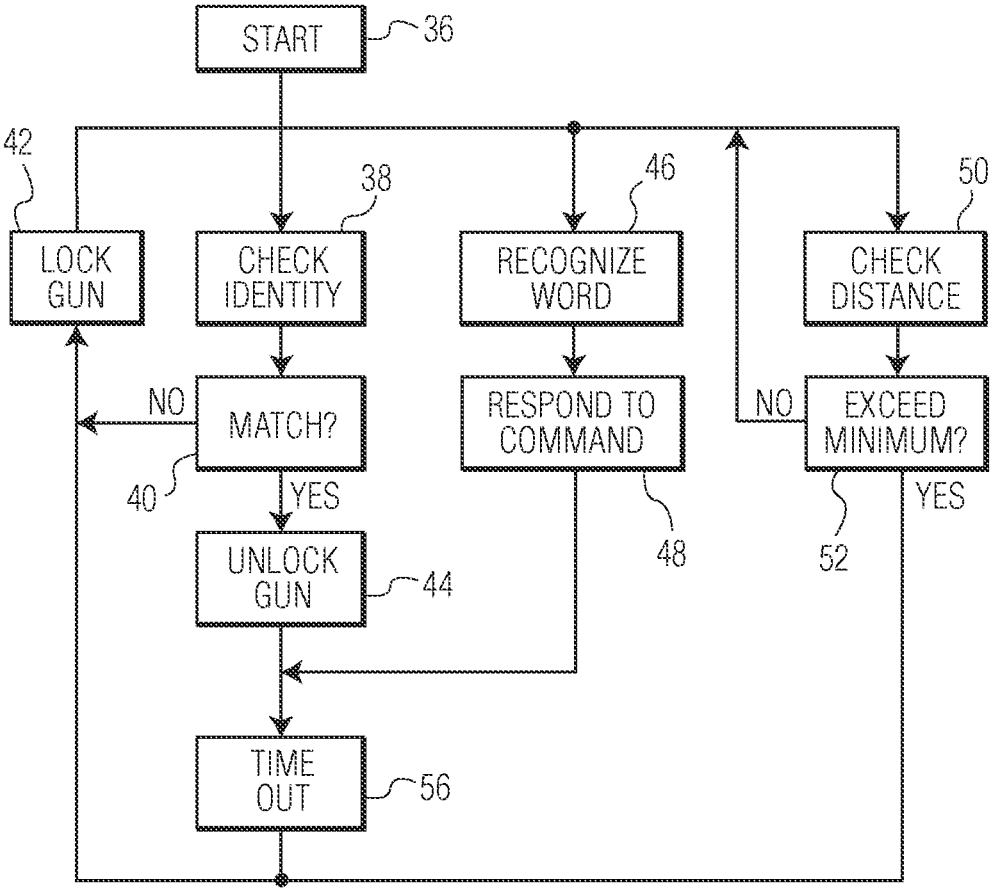
FIG. 4 is a flow chart showing the operation of a smartphone application ("App") according to the preferred embodiment of the present invention.

FIG. 4 is a flow chart of an algorithm for the app that may be used with a smartphone 10 and/or 30 to enable the owner, or any other person who is authorized to use the gun, (1) to bypass the identity check in an emergency and use the gun, and (2) to prevent the gun from firing whenever it is more than a few feet away from the smartphone (the electronic key device).

Running continuously in the background of the smartphone, the algorithm repeatedly returns to START 36. When the user's biologic ID is entered, this information is transmitted to the gun lock at CHECK IDENTITY 38. If the data fails to match the data stored in gun lock memory at MATCH 40, the gun remains locked at LOCK GUN 42 and control is returned to START. If a match is found, the gun lock device unlocks the gun at UNLOCK GUN 44.

To avoid the possibility that the gun remains unlocked indefinitely, the unlocked condition will eventually TIME OUT at 56 and the gun will again be locked at LOCK GUN 42.

According to one aspect of the invention, if a "secret word" or command is spoken by the gun owner or authorized user, the word is RECOGNIZED at 46 and the gun lock will RESPOND at 48 to execute the command and either lock or unlock the gun, depending upon the command.

The secret word can be different for locking and unlocking the gun, or it can be the same for both and simply toggle the gun lock device. In this case, if the gun is locked it will become unlocked and if unlocked it will become locked.

According to another aspect of the invention, the system algorithm constantly checks the distance between the gun lock device on the gun, on one hand, and the smartphone used as an electronic gun key device, on the other, at CHECK DISTANCE 50. If the distance EXCEEDS A MINIMUM at 52, control is passed to LOCK GUN at 42.

The recognition of the secret word at 46/48 and the distance check at 50/52 both bypass the identity check at 38/40. The gun therefore remains operative at all times in the face of an emergency.

There has thus been shown and described a novel secure smartphone-operated gun lock which fulfills all the objects and advantages sought therefor. Many changes, variations and other uses and applications of the subject invention will become apparent to those skilled in the art after considering this specification and the accompanying drawings. All such changes, variations and other uses and applications which do not depart from the spirit and scope of the invention are deemed to be covered by the claims.

What is claimed is:

1. Apparatus for locking or unlocking a gun in certain emergency circumstances, said apparatus comprising, in combination:

(a) a gun having a first source of electrical power and comprising the following components coupled to said first source of power:

(1) a gun lock mechanism, responsive to a gun command signal, for preventing firing of the gun when in a locked state and enabling firing of the gun when in an unlocked state;

(2) a wireless receiving ("R") device for receiving a gun information signal from a wireless transmitting ("T") device;

(3) a digital data memory for storing first gun security data representing biologic data identifying a person authorized to use the gun; and (4) a first digital logic device, coupled to said gun lock mechanism, to said R device and to said data memory, for receiving said gun information signal and for producing said gun command signal to set said gun lock mechanism in either said locked state or said unlocked state; and (b) a portable smartphone having a second source of electrical power and comprising the following components coupled to said second source power:

(1) a wireless transmitting ("T") device for transmitting said gun information signal to said R device;

(2) a first input device for inputting personal information from a putative authorized person who wishes to use the gun, said personal information including biologic data identifying a bodily aspect of said putative authorized person;

(3) a second input device for inputting an emergency message to either lock or unlock the gun;

(4) a second digital logic device, coupled to said T device and to said first and second input devices, for producing said gun information signal;

wherein said smartphone further includes a phone app operative to cause said second digital logic device to generate second gun security data from said personal information and to generate an emergency gun control command from said emergency message, thereby to produce said gun information signal including at least one (i) said second security data and (ii) said emergency gun control command, if any, for transmission by said T device to said R device;

wherein said first logic device is operative to produce said gun command signal to set said gun lock mechanism in the unlocked state and enable the gun to be fired when the second gun security data received by said R device are substantially the same as the first gun security data stored in said data memory, thereby evidencing that the putative authorized person is authorized to control the gun; and wherein said first logic device is further operative to produce said gun command signal to set the gun lock mechanism in either the locked or unlocked state, respectively, in dependence upon said emergency gun control command, when received, whether or not a putative authorized person has been authorized to control the gun.

2. The apparatus defined in claim 1, wherein said emergency message is a voice command, and wherein said second input device includes a microphone.

3. The apparatus defined in claim 1, wherein said emergency message includes a command for locking the gun.

4. The apparatus defined in claim 1, wherein said emergency message includes a command for unlocking the gun.

5. The apparatus defined in claim 1, wherein said first input device is operative to sense a bodily aspect of said putative authorized person which is selected from the group consisting of:

a facial image;
an image of an iris;
a retinal image;
a fingerprint image;
a palm print image; and
an image of veins of a hand;

and wherein said second logic device is operative to process said image and to generate said second gun security data therefrom.

6. The gun lock apparatus if claim 1, wherein said first input device includes a camera for producing a biologic identifying image of said bodily aspect of said putative authorized person.

7. The gun lock apparatus of claim 1, wherein said phone app is operative to cause said second digital logic device to generate said emergency gun control command from said emergency message, thereby to produce said emergency gun control command, when said digital logic device recognizes a code in said emergency message.

* * * * *